US010414574B2

(12) United States Patent
Harrington

(10) Patent No.: US 10,414,574 B2
(45) Date of Patent: Sep. 17, 2019

(54) CONTAINER FOR CARD(S) BOOKLET-LIKE ITEMS AND HAVING A SYMBOLIC PERSON-LIKE SHAPE

(71) Applicant: Kirk Harrington, Chanhassen, MN (US)

(72) Inventor: Kirk Harrington, Chanhassen, MN (US)

( * ) Notice: Subject to any disclaimer, the term of this patent is extended or adjusted under 35 U.S.C. 154(b) by 0 days.

(21) Appl. No.: 15/399,166

(22) Filed: Jan. 5, 2017

(65) Prior Publication Data

US 2018/0186515 A1 Jul. 5, 2018

(51) Int. Cl.
*B65D 81/36* (2006.01)

(52) U.S. Cl.
CPC ..... *B65D 81/365* (2013.01)

(58) Field of Classification Search
CPC ..... B65D 25/10; B65D 43/16; B65D 45/00; B65D 81/365
USPC ..... 206/472, 457; D9/614, 623, 624; 229/116.1–116.4; 220/4.24, 4.17, 4.22
See application file for complete search history.

(56) References Cited

U.S. PATENT DOCUMENTS 5,816,395 A * 10/1998 Dougherty ..... A45C 5/02 150/162
5,921,383 A * 7/1999 Shefler ..... A45C 11/04 206/38
6,283,279 B1 * 9/2001 Harrington ..... A45C 11/34 206/214
6,415,944 B1 * 7/2002 Toussant ..... A47G 19/03 220/4.23
6,758,338 B2 * 7/2004 Lien ..... B65D 25/10 206/534
D604,115 S * 11/2009 Braidotti ..... D7/628
8,783,460 B1 * 7/2014 Citro ..... A45C 11/00 206/457
2003/0038049 A1 * 2/2003 Wang ..... A45C 11/34 206/457
2007/0034625 A1 * 2/2007 Pacheco ..... A45C 3/06 220/4.21
2008/0060957 A1 * 3/2008 Ford ..... B65D 11/188 206/350
2008/0142540 A1 * 6/2008 Chang ..... B65D 83/0864 221/259
2009/0134209 A1 * 5/2009 Tonaltzin ..... A45C 13/10 229/116.1
2013/0056018 A1 * 3/2013 Anderson-Stimson ..... A45C 15/04 132/316

* cited by examiner

*Primary Examiner* — Chun Hoi Cheung
(74) *Attorney, Agent, or Firm* — Fredrikson & Byron, P.A.

(57) ABSTRACT

A container for at least one card booklet-like item and having a symbolic person-like shape. The container has substantially identical external-shaped top and bottom planar members, each having a head portion, a body portion, two spaced-apart leg portions and two arm portions. In one embodiment, a person-shaped cutout is formed in a top member that overlies a similar shaped recess in the bottom member when the top member is assembled with the bottom member.

8 Claims, 9 Drawing Sheets

CONTAINER FOR CARD(S) BOOKLET-LIKE ITEMS AND HAVING A SYMBOLIC PERSON-LIKE SHAPE

BACKGROUND OF THE INVENTION

The prior art contains numerous examples of storage boxes and the like having a wide variety of shapes and sizes, for the storage of school supplies, for example.

SUMMARY OF THE INVENTION

The embodiments of the present invention provide, in general terms, a container for at least one card booklet-like item where the container has a symbolic person-like shape, a shape well calculated to appeal to children because of its doll-like configuration.

More specifically, the embodiments of the present invention provide a container as aforedescribed and comprising substantially identical externally shaped top and bottom members. Each of the members is flat, i.e., planar, and has a preselected thickness. Each of the members has a head portion, a body portion having an upper end and a lower end, and two spaced-apart leg portions extending longitudinally in parallel spaced-apart relationship from the lower end of the body. Each member further has two arm portions connected respectively to opposite lateral sides of the upper end of the body portion, and extending longitudinally downwardly in spaced-apart parallel relationship with the body portion.

The bottom member has an inside surface and a recess extending part way, but not through, the member. More specifically, the recess is located in the upper body portion of the container for receiving at least one card booklet-like item, such as a booklet on values, avoidance of alcohol or other drugs, and other societal issues etc. The bottom member further includes a pair of spaced-apart fastening members.

The top member of the container also has an inside surface with longitudinally spaced-apart fastening means positioned and adapted to co-act with fastening means of the bottom member, so as permit and provide selective assembly and disassembly of said top and bottom members. In the preferred embodiment, the fastening means integral with the top member are female means and the fastening means integral with the bottom member are male means. Alternatively, the fastening means on both the upper and lower members may be smooth magnets of opposite polarity. The recess formed in the bottom member preferably is in a similar person-like shape as the container.

DETAILED DESCRIPTION OF THE INVENTION

Figure 1:
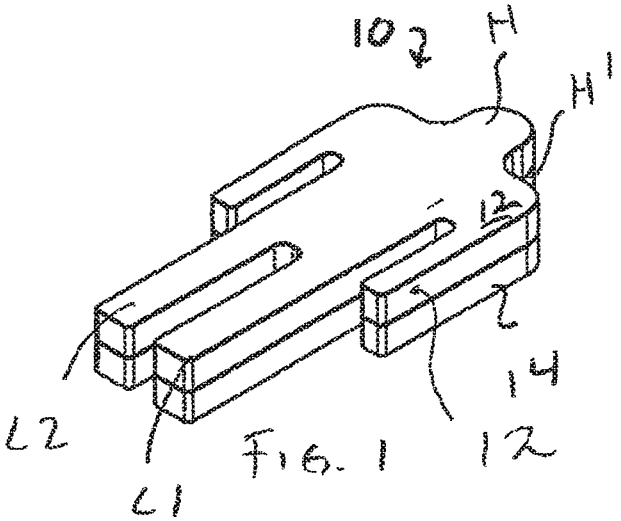
FIG. 1 is a front perspective view of a container representing a preferred embodiment of my invention.
Figure 2:
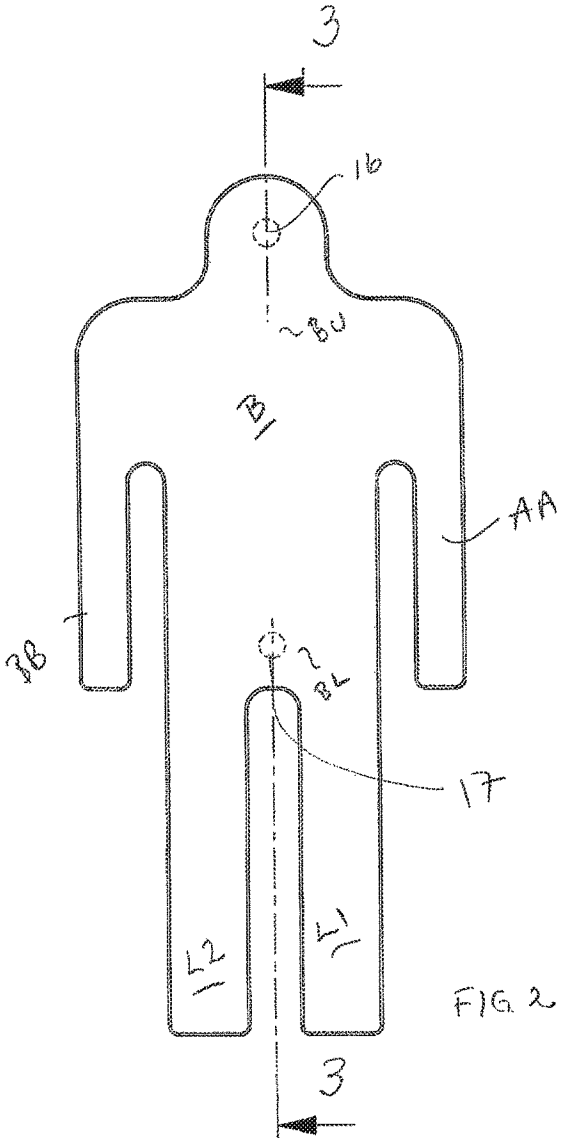
FIG. 2 is a front plan view of the container shown in FIG. 1.
Figure 4:
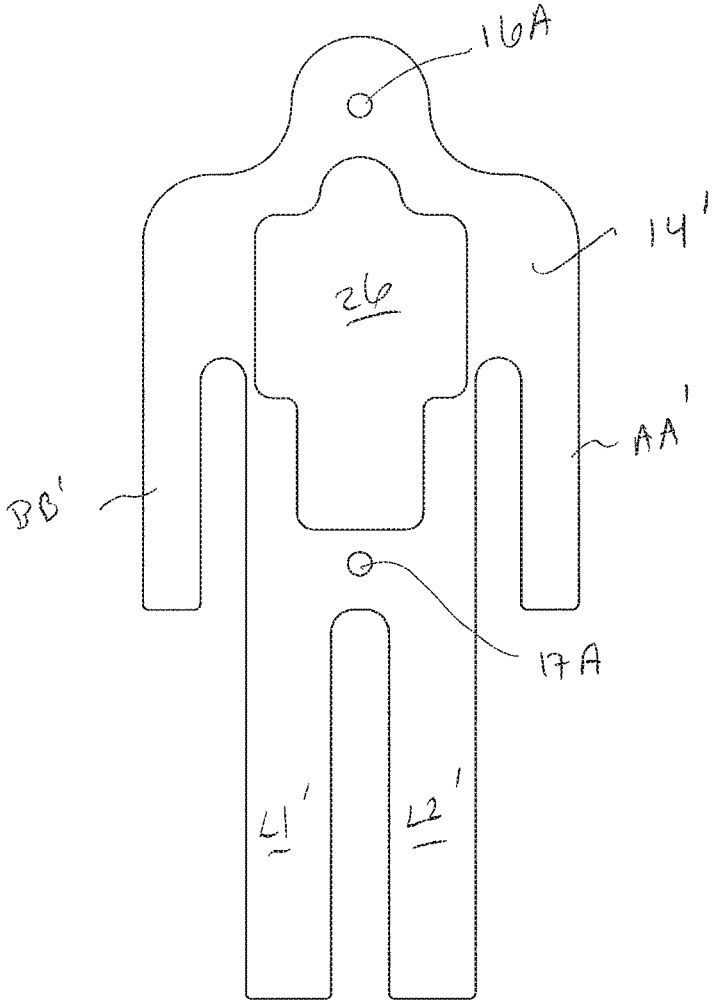
FIG. 4 is a perspective view of the bottom member of the container shown in FIG. 1.

FIG. 1 is a front perspective view of a container representing a preferred embodiment of my invention. The container for at least one card booklet-like item has a person-like shape. The container 10 has substantially, identically externally-shaped top and bottom members: a top member 12 and a bottom member 14. Members 12 and 14 are shown to be flat, i.e., planar, and have a preselected thickness which, in the preferred embodiment, are equal. Members 12 and 14 have head portions H and H', respectively. Top member 12 has a body portion B having upper and lower ends BU and BL, respectively; likewise, bottom member 14, as shown in FIG. 4, has upper and lower body ends BU' and BL'. Top member 12, as shown in FIGS. 1 and 2, has a pair of spaced-apart leg portions L1 and L2 extending longitudinally in parallel spaced-apart relationship from the lower end BL of the body portion; the corresponding legs for the bottom member 14 are L1' and L2', as shown in FIG. 4. The top member 12 further comprises two arm portions AA and BB connected respectively to opposite sides of the upper end BU of the body portion. As shown clearly in FIG. 2, the arm portions AA and BB extend longitudinally downwardly in spaced-apart parallel relationship with the body portion B. Likewise, the bottom member 14 has corresponding arms AA' and BB', connected respectively to opposite sides of the upper end BU' and extending longitudinally downwardly in spaced-apart parallel relationship with the body portion.

The bottom member 14 has an inside surface 14' shown in FIG. 4, and has a person-shaped recess 26 provided in the inside surface of member 14 in the body zone. As depicted in FIG. 4, recess 26 has significant longitudinal and transverse extents as well as depth, so as to provide an appropriate storage for at least one card booklet-like item. In a preferred embodiment, the recess 26 can accommodate a range of about 10 L2 30 cards and most preferably about 20-25 card.

The invention further provides means for selective repeatable assembly and disassembly of the top and bottom members 12 and 14. In the preferred embodiment, this function is provided by a pair of longitudinally spaced-apart, fastening means 16, 17 and 16A, 17A, located on the inner surfaces of the top and bottom members respectively. In a preferred embodiment, the fastening means 16, 17 and 16A, 17A on the top and bottom members 12 and 14 respectively are complementary magnets. In another embodiment, they may be hook-and-loop type fasteners. Alternatively, the fasteners may be male and female-type fasteners.

In use, the container, when assembled, may be stood on end with the four legs L1, L1', L2 and L2' supporting the container, and the container may also be laid flat on a supporting surface. If a child or other user wants to gain access to the contents of the recess 26, then the user merely pulls the members 12 and 14 apart, preferably keeping the bottom member 14 in a bottom-horizontal positon, so as to avoid the spilling of the contents from the recess. The fastening means 16 and 17, and 16A and 17A, permit easy disassembly of members 12 and 14, as well as reliable reassembly whereby the assembled members can be vigorously handled without fear of an unintended disassembly with a spilling of the contents of the recesses.

Figure 3:
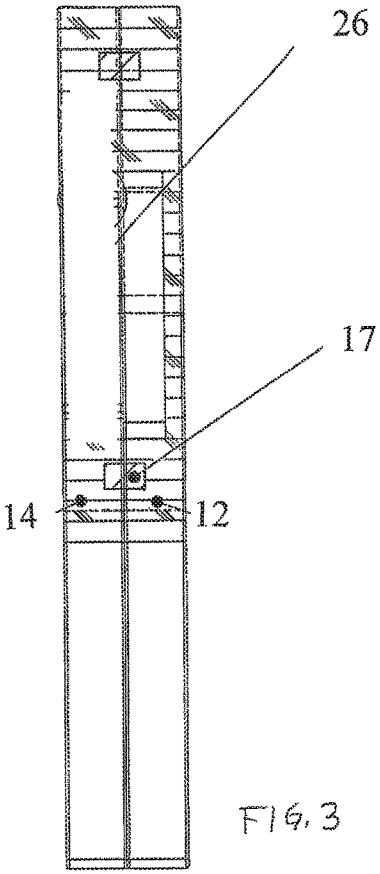
FIG. 3 is a cross-sectional view of the container shown in FIG. 1 taken along lines 3-3'.

In a preferred embodiment, the first and second members are made of wood. As can be seen in the cross-sectional view of FIG. 3, the top member 12 does not have a recess but is preferably solid across its thickness.

Figure 5:
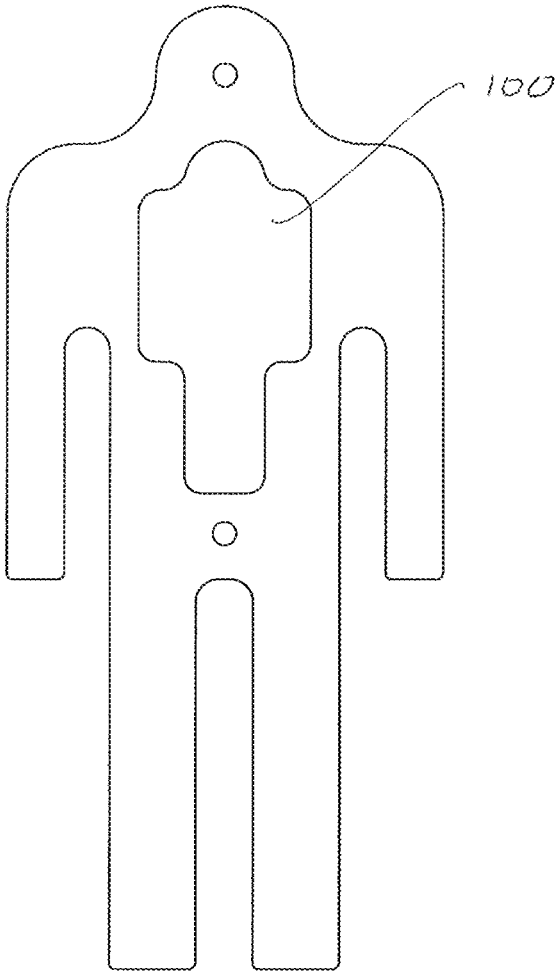
FIG. 5 is a front elevation view of a container representing another preferred embodiment of my invention.
Figure 6:
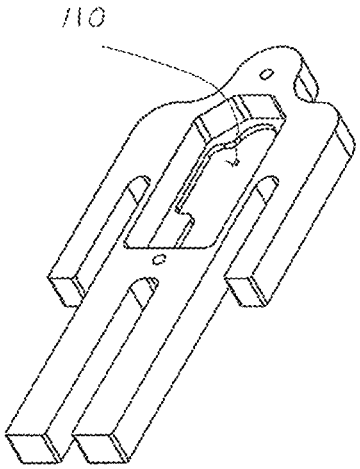
FIG. 6 is a rear plan view of the upper member of the container shown in FIG. 5.
Figure 7:
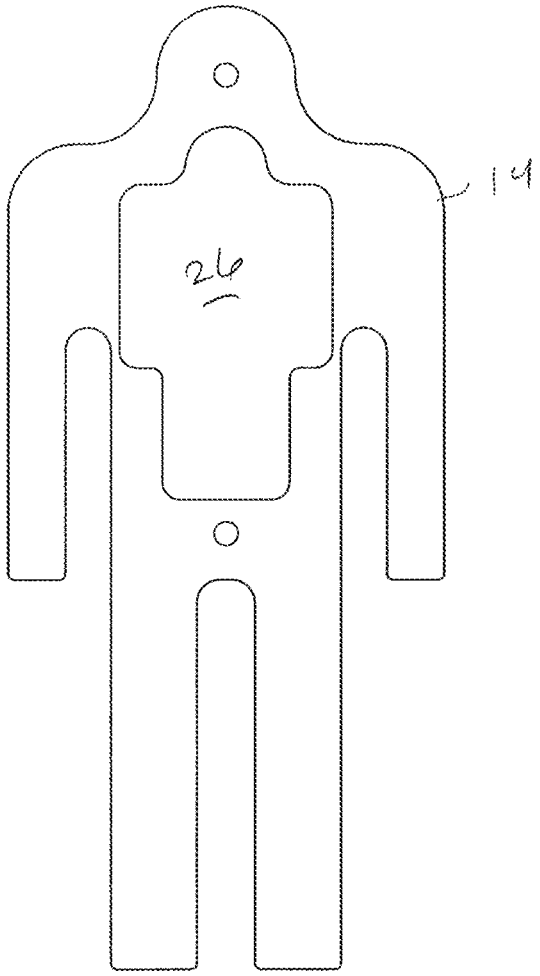
FIG. 7 is a plan view of the bottom member of the container shown in FIG. 5.
Figure 8:
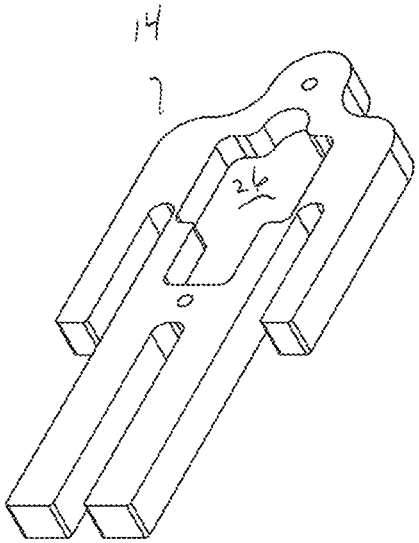
FIG. 8 is a perspective view of the bottom member of the container shown in FIG. 7.

FIG. 5 is a front elevation view of a container representing another preferred embodiment of my invention. This embodiment is substantially the same as that shown in FIGS. 1-4 so the same reference numbers will be used for similar parts. The embodiment shown in FIG. 5 differs from the embodiment shown in FIGS. 1-4 in that the top member 12 a cutout 100 formed through the thickness of the top member. The cutout 100 is preferably in a substantially same person-like shape as the top member. FIG. 6 is a rear plan view of the upper member of the container shown in FIG. 5. Located on an inner surface of the top member is a magnifying lens preferably in plastic that covers the person-shaped cutout. When the top member is assembled to the bottom member, the person-like shape cutout in the top member overlies the person-like shape recess in the bottom member 14. The magnifying lens magnifies the contents in the recess 26 of the bottom member. The bottom member shown in FIGS. 7 and 8 is the same as the embodiment shown in FIGS. 1-4.

In a preferred embodiment, the first and second members are made of wood.

Figure 9:
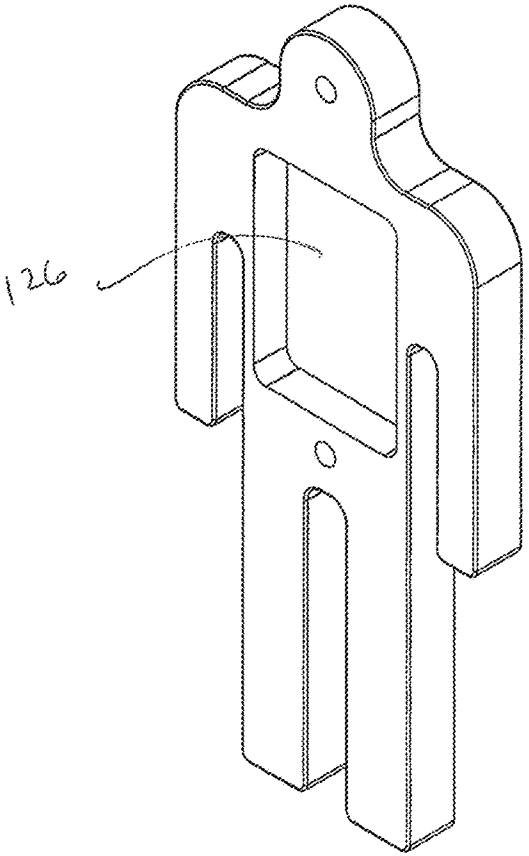
FIG. 9 is a perspective view of a bottom member of the container representing still another preferred embodiment of my invention.
Figure 10:
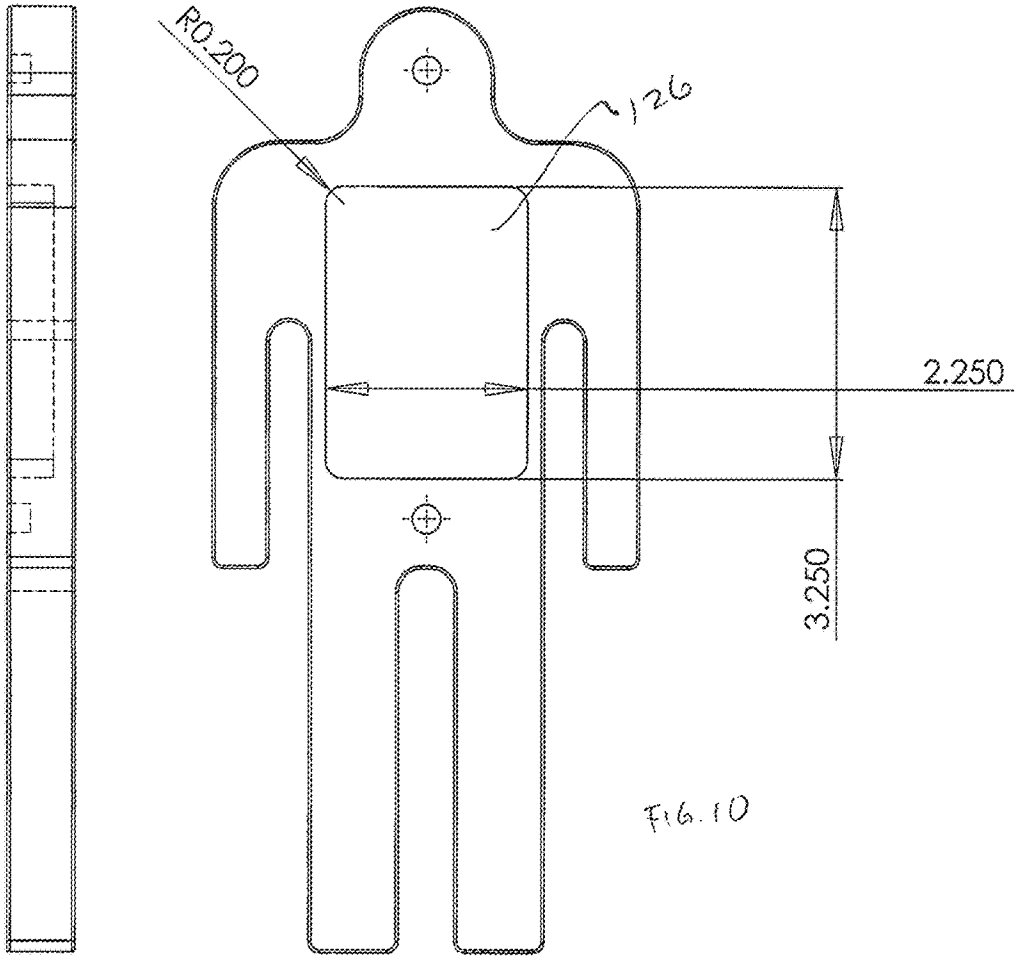
FIG. 10 is a plan view of the container shown in FIG. 9.

FIGS. 9 and 10 illustrate another embodiment of the bottom member where the recess 126 is in the shape of a rectangle instead of a person.

Figure 11:
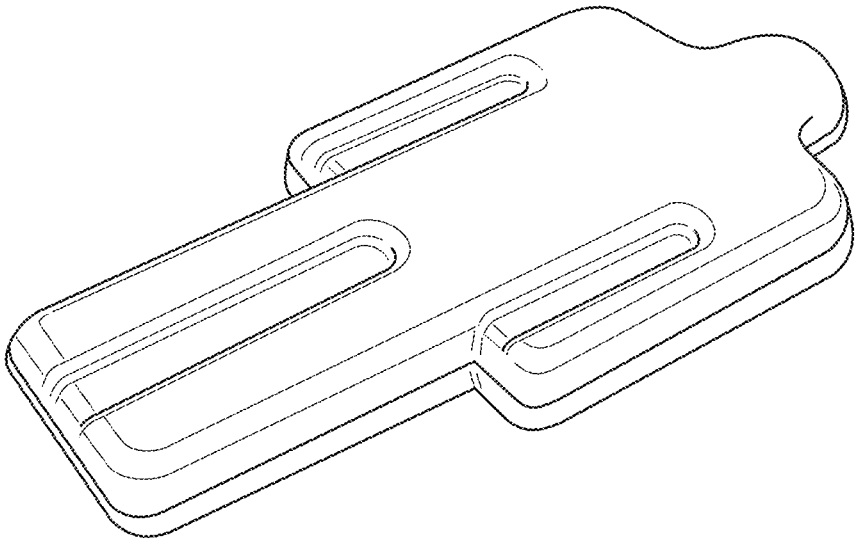
FIG. 11 is a front perspective view of a container representing another preferred embodiment of my invention.
Figure 12:
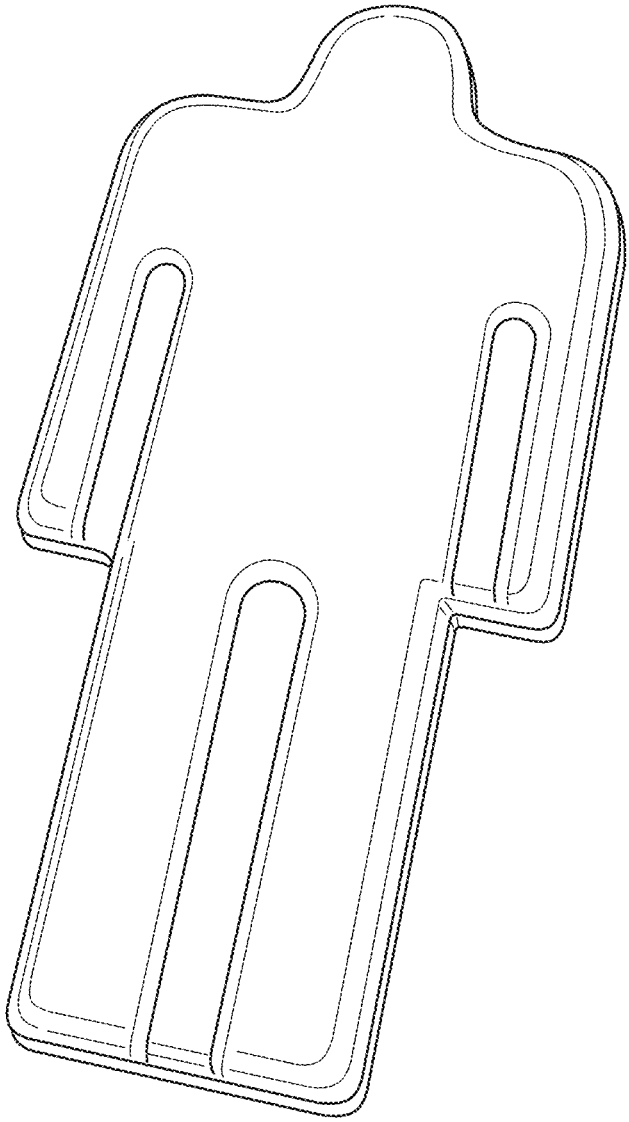
FIG. 12 is a front plan view of the container shown in FIG. 11.
Figure 13:
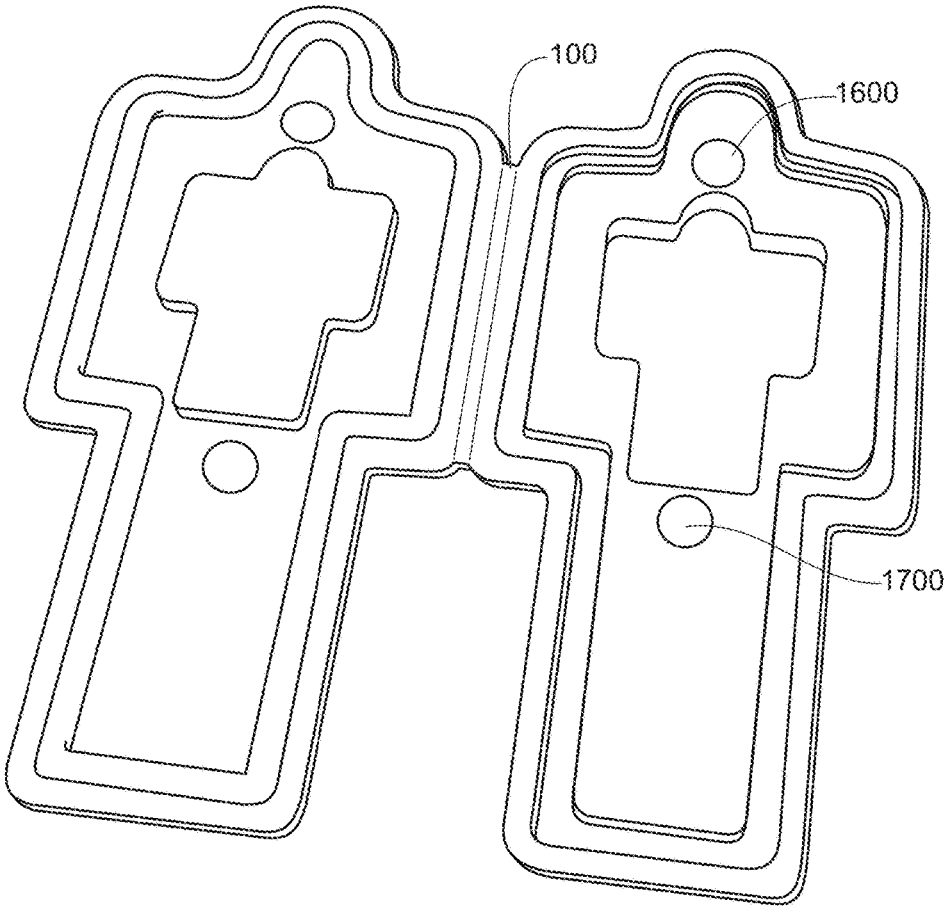
FIG. 13 is front plan view of the container of FIG. 11 shown in an open state.

FIG. 11 is a front perspective view of a container representing a preferred embodiment of my invention. This embodiment is similar to that shown in FIGS. 1-10 except that the top and bottom members are joined together along a seam 100 (see FIG. 13) at the side of one arm so that when the top is disassembled from the bottom, it is folded open like a book and the top and bottom member remain coupled along that seam.

In a preferred embodiment, the first and second members are made of a cloth-covered foam and the fastening elements 1600 and 1700 are hook-and-loop type fasteners.

While the preferred embodiment of the invention has been illustrated, it will be understood that variations may be made by those skilled in the art without departing from the inventive concept. Accordingly, the invention is to be limited only by the scope of the following claims.

What is claimed is:

1. A container for at least one card booklet like item, the container having a symbolic person-like shape, said container comprising:

substantially identically externally shaped top and bottom members, each of said members being planar and having a preselected thickness, a head portion, a body portion having an upper end and a lower end, two spaced-apart leg portions extending longitudinally in parallel spaced-apart relationship from said lower end of said body, and two arm portions connected respectively to opposite sides of said upper end of said body portion and extending longitudinally downwardly in spaced-apart parallel relationship with said body portion;

said bottom member having an inside surface, a first person-like shaped recess in said inside surface of said body portion for receiving the at least one card booklet-like item, and longitudinally spaced-apart fastening means;

said top member having an inside surface with longitudinally spaced-apart fastening means adapted to co-act with said bottom member fastening means to provide selective assembly and disassembly of said top and bottom members; and a second person-like shaped cutout formed through the thickness of the top member wherein the second person-like shaped cutout overlies the first person-like shaped recess in the bottom member when the top member is fastened to the bottom member.

2. The container of claim 1, wherein said fastening means comprise female means on one of said members and male means on the other of said members.

3. The container of claim 1 wherein the fastening means comprises magnets.

4. The container of claim 1 wherein the fastening means comprises hook-and-loop fasteners.

5. The container of claim 1 further comprising a magnifying glass placed in the second cutout to occupy the entire space.

6. The container of claim 1 wherein the top and bottom members are made of wood.

7. The container of claim 1 wherein the top and bottom members are made of cloth-covered foam.

8. The container of claim 7 wherein the one of the arm portions of the top and bottom members are joined together along an edge so that the top members can be folded away from the bottom member like a book.

* * * * *